US007165013B2

(12) United States Patent
Watson

(10) Patent No.: US 7,165,013 B2
(45) Date of Patent: Jan. 16, 2007

(54) SCUBA DIVER ELECTRONIC ASSISTANT

(76) Inventor: Patrick Watson, 12703 Wolf Creek Ct., Humble, TX (US) 77346

( * ) Notice: Subject to any disclaimer, the term of this patent is extended or adjusted under 35 U.S.C. 154(b) by 115 days.

(21) Appl. No.: 10/752,371

(22) Filed: Jan. 6, 2004

(65) Prior Publication Data

US 2005/0149291 A1 Jul. 7, 2005

(51) Int. Cl.
*G06F 5/12* (2006.01)

(52) U.S. Cl. ..... 702/188; 702/179; 702/182; 702/183

(58) Field of Classification Search ..... 702/45, 702/150, 182, 183, 188, 189, 179; 340/426.16; 367/128, 131; 405/136, 188; 701/13
See application file for complete search history.

(56) References Cited

U.S. PATENT DOCUMENTS 5,956,291 A * 9/1999 Nehemiah et al. ..... 367/131
5,990,846 A * 11/1999 Dichter ..... 343/872
6,347,627 B1 * 2/2002 Frankie et al. ..... 128/201.21
6,807,127 B1 * 10/2004 McGeever, Jr. ..... 367/128

* cited by examiner

*Primary Examiner*—Marc S. Hoff
*Assistant Examiner*—Felix Suarez

(57) ABSTRACT

The present invention is an electronic device to assist divers including scuba divers. The electronic device is submersible under water and is water tight and pressure proof to a range of depths usually achieved by divers, including scuba divers. The electronic computing device includes a microprocessor coupled to a display screen, a control panel, and memory. The device further includes a digital camera subsystem coupled to the microprocessor for capturing an image under water and transmitting the captured image to the memory. Additionally, the device includes a satellite communication receiver subsystem such as a GPS receiver coupled to the microprocessor for calculating the exact location of the user from received satellite signals.

19 Claims, 7 Drawing Sheets

SCUBA DIVER ELECTRONIC ASSISTANT

BACKGROUND

This invention relates to computing devices and more particularly, computing devices to be used underwater. Various specialize devices exist for assisting scuba divers. However these devices are not integrated into a single electronic unit. There are dive computers to assist a diver by calculating and displaying information such as water depth, water temperature and time-at-depth. There other devices to help capture digital images under water. Typically, these devices are individual devices that must be carried separately by a diver which can be cumbersome. For scuba diving to be safe, efficient, and enjoyable, an integrated self-contained electronic device to assist scuba divers is needed.

SUMMARY

An underwater scuba diving assistant is described. In one embodiment, the present invention includes a waterproof electronic computing device. The electronic device includes a microprocessor, memory, and a control panel. Captured diving status parameters are monitored and displayed to the user. The preferred embodiment includes a digital camera subsystem for capturing still images and video images under water and transmitting these images into memory of the electronic computing device. Additionally, this embodiment includes a satellite receiver subsystem for assisting in land and water navigation. The microprocessor is the brains of the device and interfaces via the control panel with the digital camera subsystem and the satellite receiver subsystem.

DETAILED SPECIFICATION

Figure 1:
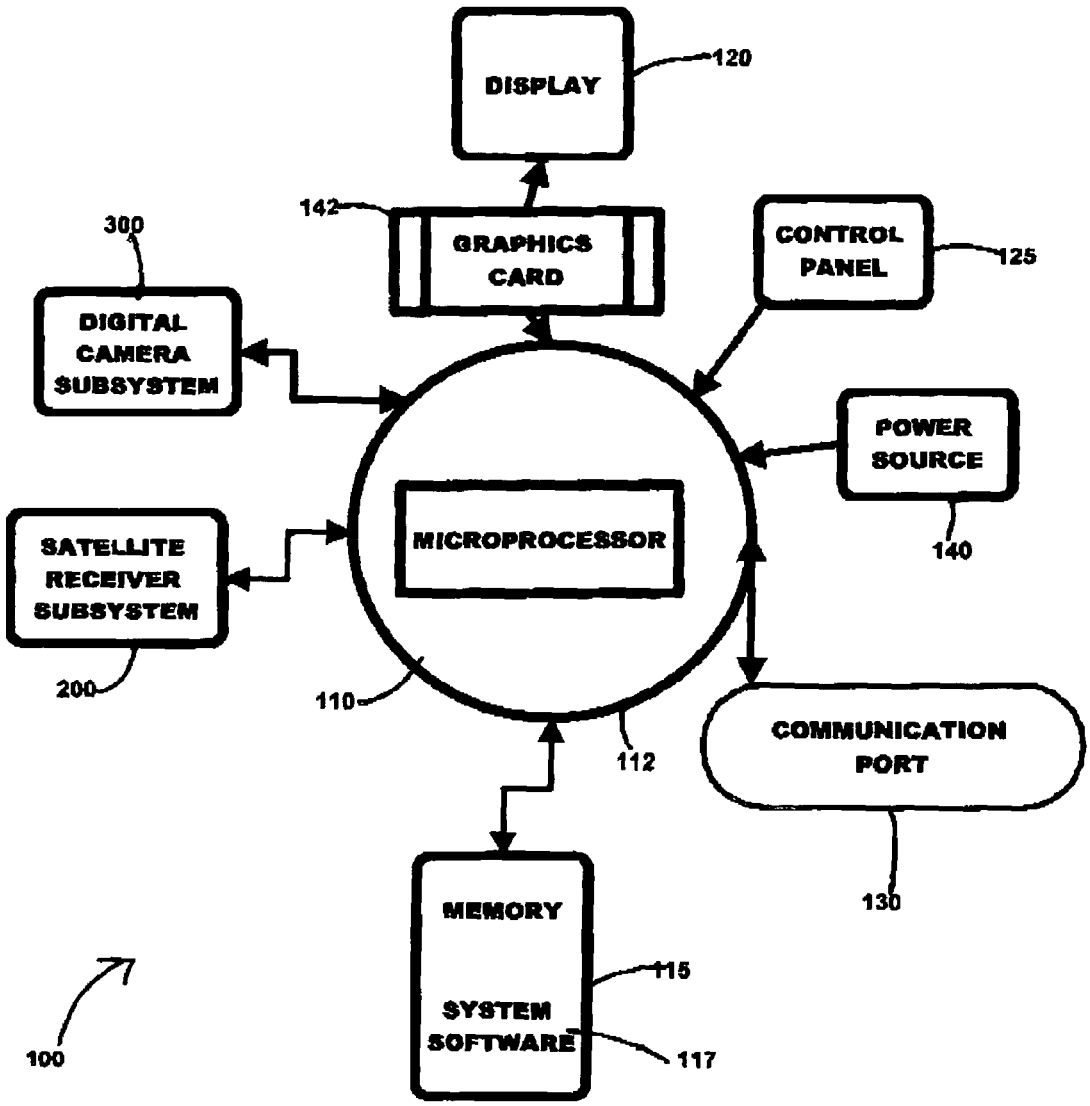
FIG. 1 is a block diagram of the overall system of the present Invention.

FIG. 1 shows an overall block diagram of one embodiment of the present invention, a small water submersible electronic computing device (100). This device includes at least one microprocessor (110), bus (112), memory (115), display member (120), and control panel (125). Microprocessor (110) is the brains of device (100) which carries out the computer instructions. Microprocessor (110) can be an Intel Pentium 4 or AMD XP 2000 or another such compatible microprocessor. Bus (112) connects all the various hardware components to the microprocessor (110). Control panel (125) is the main input device that prompts the user for input commands. Communication port (130) is utilized to connect computing device (100) to a host computer (not shown). The host computer can be a PDA, LAP TOP, Desktop, minicomputer, or removable disk storage.

Communication port (130) provides the capability of downloading information into memory (115) or uploading information from memory (115) into the memory of the host computer. Additionally, communication port (130) can be utilized to synchronize electronic device (100) with a host computer for backup purposes. Electronic device (100) further includes a power source (140), which can be a rechargeable battery unit. Additionally, the power source (140) can include diver backup replaceable batteries. In this kind of embodiment, the power source can further include a portable battery unit enclosed in a waterproof covering. A waterproof electrical receiver connector is operably connected to the battery unit and a waterproof electrical mate connector is operably connected to the electronic device (100). While under water a diver can disconnect the receiver connector from the mate connector, remove the current power unit and replace the power unit by reconnecting the receiver connector of the new power unit to the mate connector of the device.

Memory (115) shown in FIG. 1 can comprise various types of memory devices as required to support the functions of the diving status subsystem, the satellite receiver subsystem, and the digital camera subsystem. The various types of memory devices include static random access memory (SRAM), dynamic RAM, flash RAM, read only memory (ROM), and programmable ROM (PROM).

As depicted, device (100) further includes a diving status subsystem (150), a digital camera subsystem (300) and a satellite receiver (200) coupled to microprocessor (110) which are described below. Additionally, device (100) hardware and software components are fully integrated into one functional electronic unit. As described below, the system software (117) implemented in memory (115) controls and coordinates the operation of the hardware and various software components of device (100).

Figure 1A:
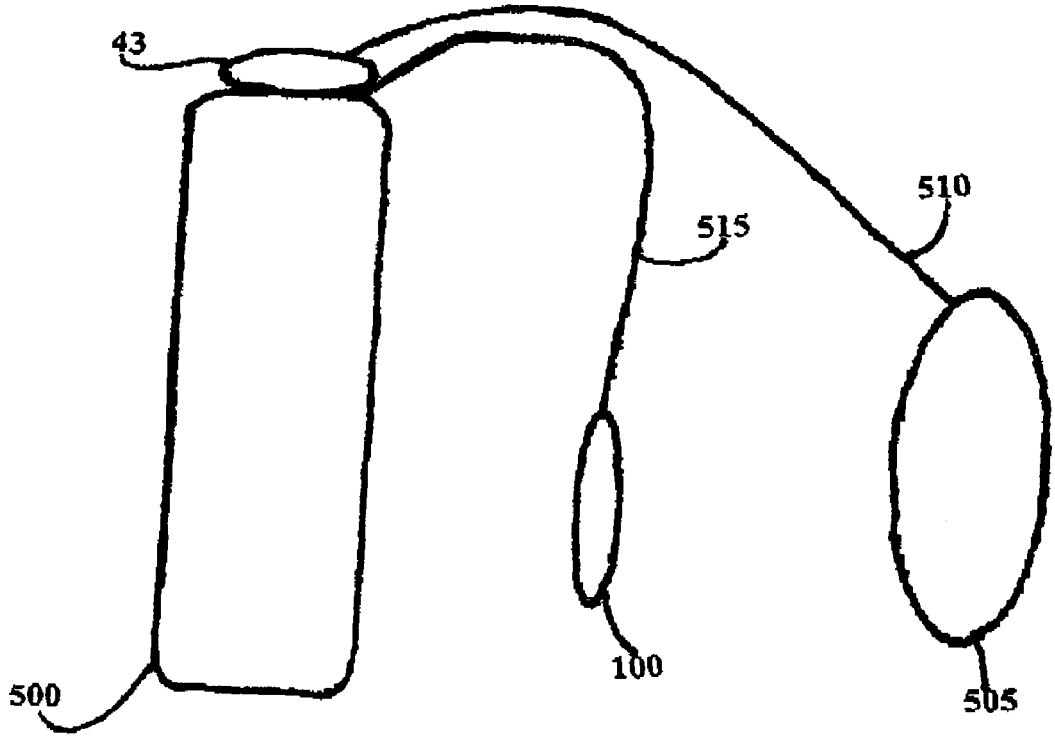
FIG. 1A is illustrates the present invention connected to a buoyancy device.

As depicted in FIG. 1A, device (100) is integrated to monitor air tank (500) via air hose (515). Additionally, buoyancy device (505) is connected to air tank (500) via air hose (510). Generally, buoyancy device (505) is normally a diver's vest which is utilized to control the diver's depth under water. In this embodiment, regulator valve (43) is operationally mounted to air tank (500) and connected to device (100) via hose (515). Regulator valve (43) contains sensors which can allow device (100) to monitor the amount of air in tank (500), the diver's breathing rate, and the diver's nitrogen body content.

Figure 1B:
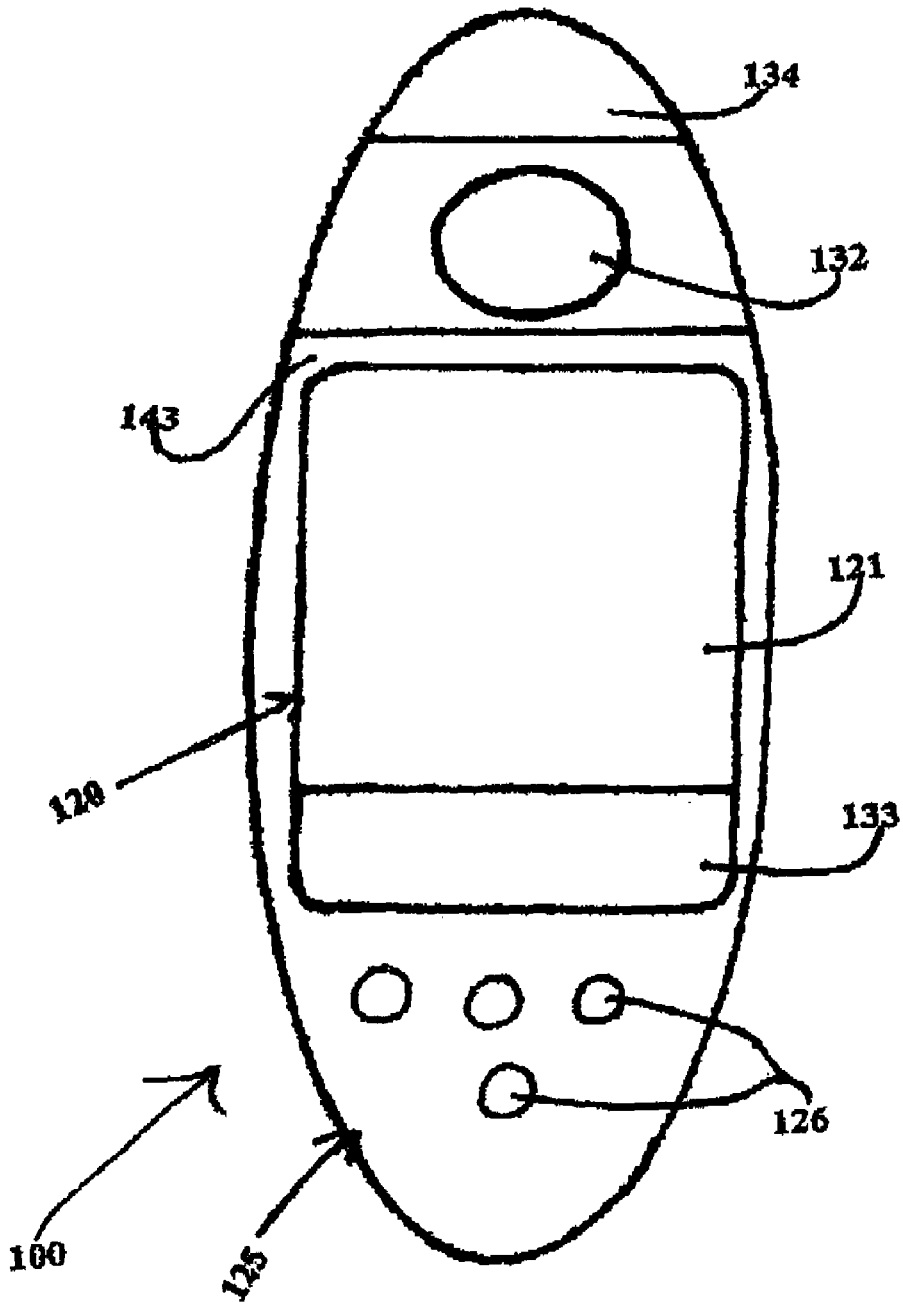
FIG. 1B is a front perspective view of the present invention.

FIG. 1B illustrates a front view of one embodiment of the present invention. Electronic device (100) is surrounded by a waterproof casing (143). In the illustrated embodiment display member (120) is a flat panel display situated behind a transparent waterproof covering. As shown, flat panel display (121) can be an LCD or another such compatible display technology. A backlight is attached behind the flat panel assembly (121) to provide illumination while diving underwater. In some embodiments, the diver can adjust the level of illumination of the backlight. As shown in FIG. 1, display member (120) can be attached to a graphics card (142) to provide full color graphics display. Graphics card (142) can contain memory and a dedicated processor for handling the special command set for displaying graphics on the flat panel assembly (121) shown in FIG. 1.

As depicted in FIG. 1B, display member (120) can comprises a plurality of display sections. Display section 132 can display compass information. Display section (133) can continuously display critical diver vitals such as the diver's depth and the amount of air in the tank (500). Display section (134) can display the GPSS information. Display section (121) would be the general display area.

In the illustrated embodiment in FIG. 1B, control panel (125) comprises various buttons. With this configuration, buttons (126) on the control panel are designated to control the operation of each subsystem of the present invention. Additionally, other buttons are designated to control the operation of the overall device. For example, a system power on/off button is required. Other buttons can include a selection for going up, down, left, or right on the flat panel display (121) and an enter operation for selecting a specific command.

Figure 1C:
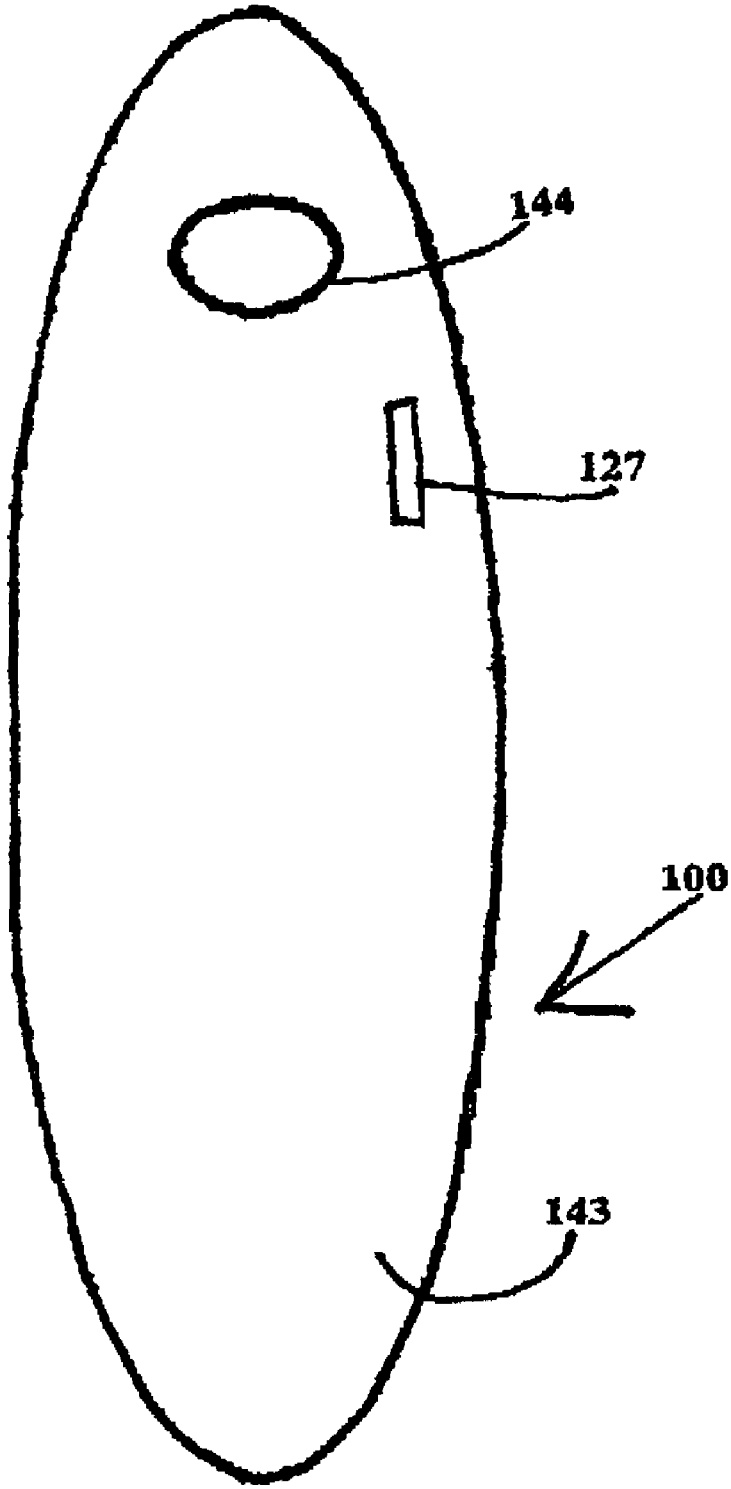
FIG. 1C is a back perspective view of the present invention.

As depicted in FIG. 1C, camera lens (144) is operably attached to the backside of device (100). Lens (144) can automatically focus underwater. However, buttons (126) will be needed to control camera operation. For example, the lens will have to be zoomed in or out. Additionally, the camera will need to be turned on or off. The camera subsystem will have to be switched between video recording mode and still picture mode. Also, the video or the pictures will need to be captured, deleted, and viewed. As shown, the present invention can further include temperature sensors (127) mounted upon the backside of the device and operationally connected to microprocessor such that the temperature underwater can be monitored while the diver is ascending and descending.

Figure 2:
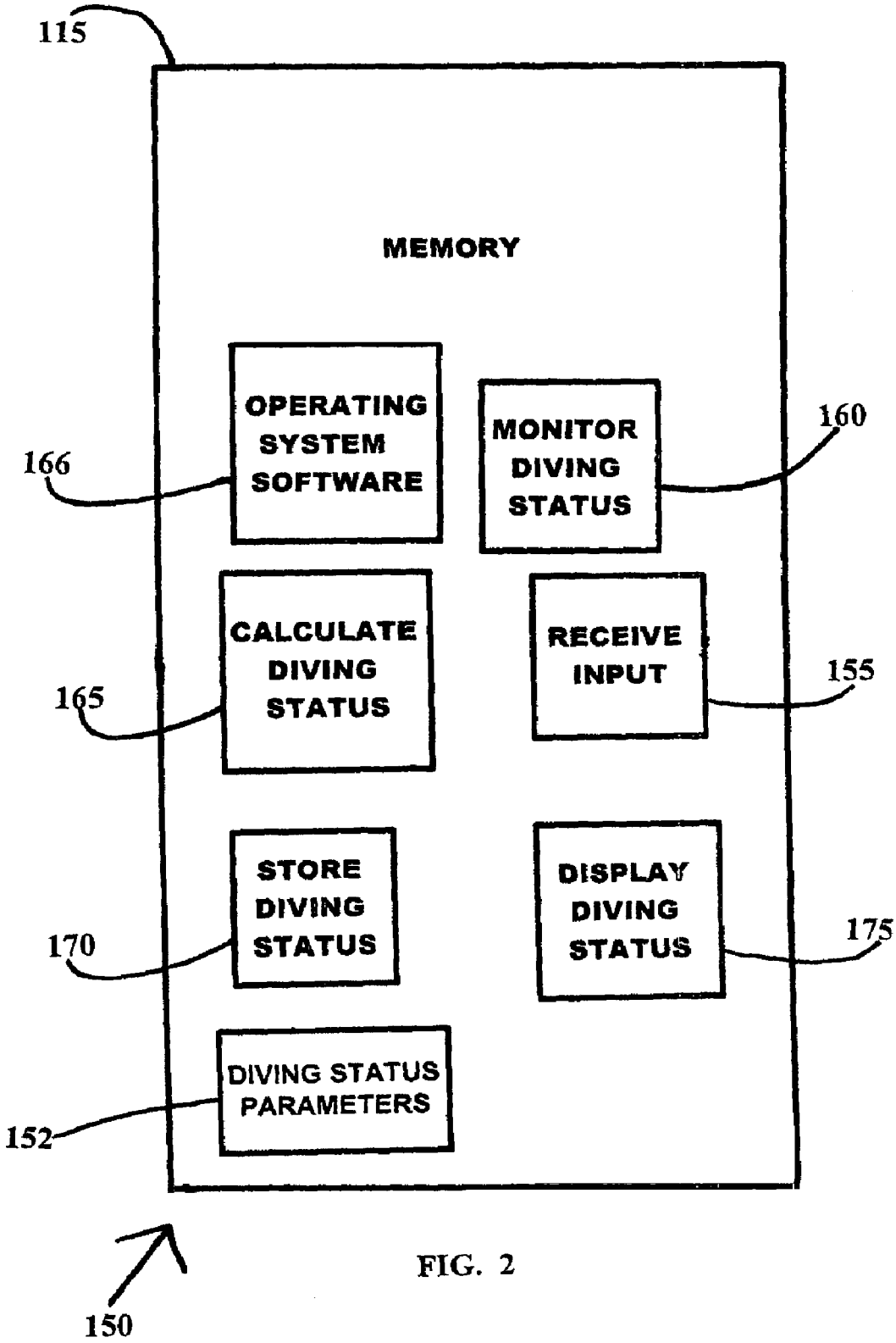
FIG. 2 is an exploded block diagram of the diving computer subsystem.

FIG. 2 is a block diagram of one embodiment of the software functions implemented in memory (115) for the diving status subsystem (150). For underwater diving, several status parameters are important and can be monitored, for example, nitrogen intake, decompression status, temperature, air supply, current depth, maximum depth, current time, maximum bottom time.

FIG. 2 illustrates a block diagram of one embodiment of the software modules of diving subsystem (150) implemented in memory (115). With the diving status subsystem (150), the microprocessor is programmed through several software modules that monitor and track the diver while under water. Operating system software (166) coordinates the overall operation of the hardware components of device (100). Initially, with software module (155) the user inputs diving profile information through the control panel. Then, diving status parameters (152) are created from the user's diving profile information. As the diver descends under water and remains under water, the diving status parameters are continually monitored in software module (160) and continually recalculated in software module (165). As the diving status parameters (152) are recalculated, they are stored by software module (170). In software module (175), the diving status parameters are formatted to be displayed onto the display member.

Figure 3:
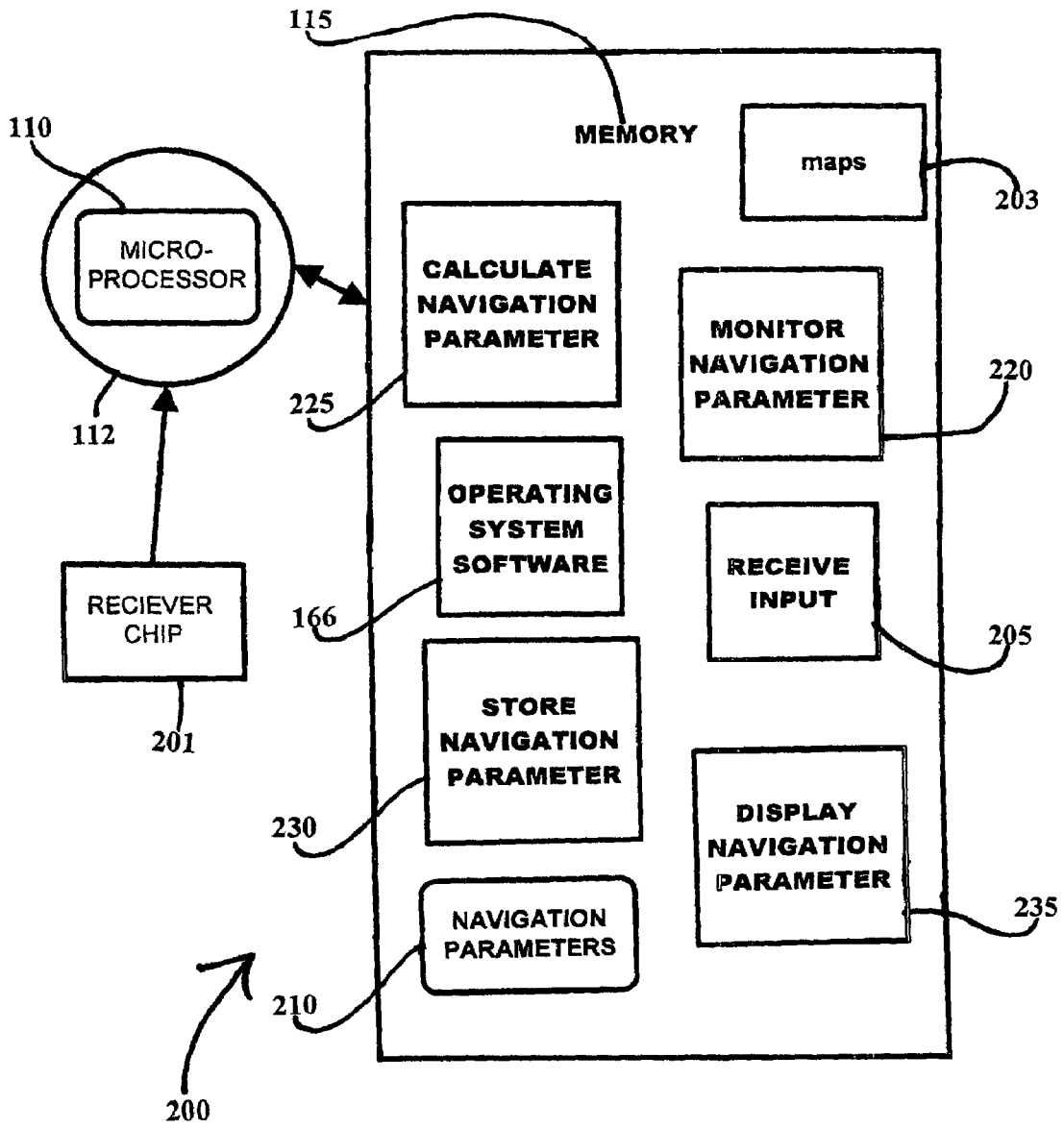
FIG. 3 is an exploded block diagram of the satellite receiver subsystem.

FIG. 3 is a block diagram of one embodiment of the hardware and the software components for the satellite receiver subsystem (200). The satellite receiver subsystem (200) further includes a GPS satellite receiver chip (201) which can be the Garmin's Multitrac8. GPS receiver chip (201) is utilized to determine position by locking on to the signals of at least three satellites, known as trilateration. Using trilateration, the GPS receiver calculates the latitude, longitude, and altitude of the user's position. Additionally, the GPS receiver can calculate speed, bearing, track, trip distance, distance to destination, sunrise time, and sunset time. In some embodiments, navigation maps (203) can be stored in memory.

With the satellite receiver subsystem (200) as shown in FIG. 3, the microprocessor is programmed through several software modules to monitor and to track navigation parameters. Initially, with software module (205) the user can input specific navigation settings through the control panel. Then, navigation parameters (210) are created from the user's provided navigation settings. The navigation parameters (210) are continually monitored in software module (220) and continually recalculated in software module (225). As the navigation parameters (210) are recalculated they are stored in software module (230). In software module (235), the navigation parameters (210) are formatted to be displayed onto the display member. For example, GPS receiver (201) will determine the user's position. Then module (205) will accept the user's waypoints, the coordinates for a particular destination position. Next, module 225 will calculate a route utilizing navigation maps (203) stored in memory (115). The route can be displayed on display (120) utilizing graphics card (142) illustrated in FIG. 1.

Figure 4:
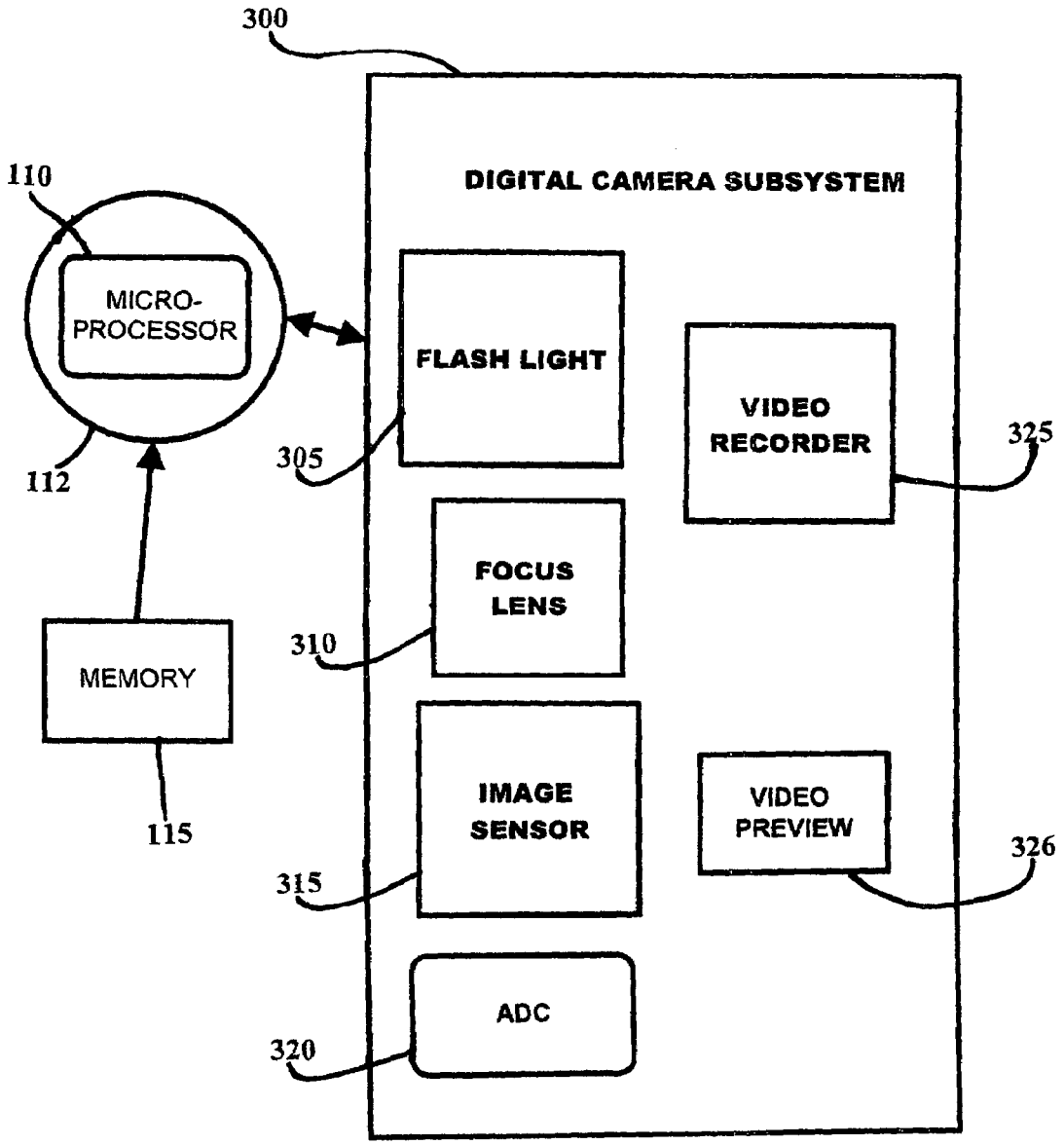
FIG. 4 is an exploded block diagram of the digital camera subsystem.

Referring to FIG. 4, there is shown a block diagram of one embodiment of the hardware and software components necessary to support the digital camera subsystem (300). The subsystem (300) further includes a flash light (305), focus lens (310), image sensor (315), analog to digital converter (ADC)(320) and a video recorder (325). The focus lens (310) are utilized to focus light to create an image of the scene which is then recorded electronically by the sensor (315). The image sensor (315) can be charged coupled device (CCD) or complementary metal oxide semiconductor (CMOS) or another suitable image sensor (315). The ADC (320) converts each electronically recorded image into a digitally recorded image. Video recorder (325) records several frames per second (i.e. at least 30 frames per second), which is combined to give the effect of movement. Thus, several gigabytes of memory (115) are required to store a small video during underwater diving and flash memory can be utilized for this purpose. Video preview (326) provides the capability of playback of the recorded video on display (120) shown in FIG. 1. The digital camera subsystem (300) provides the capability of taking still photos as well as a video stream.

What is claimed is:

1. An air integrated electronic device to assist divers, the device comprising:

a submersible electronic computing device, having a display screen, control panel, and a memory, wherein the unit is water tight and pressure proof to a range of depths usually achieved by divers, including scuba divers;

at least one microprocessor coupled to the display screen, control panel, and the memory;

a digital camera subsystem coupled to the at least one microprocessor wherein the digital camera subsystem captures images and transmits the captured images to the memory;

a satellite communication receiver subsystem coupled to the at least one microprocessor, the satellite communication receiver subsystem for receiving satellite signals from an earth orbiting satellite for calculating a user's location based upon the received satellite signals; and the at least one microprocessor being operationally connected to a diver's air tank for continuously monitoring the amount of air in the tank and the diver's breathing rate.

2. The device of claim 1 wherein the at least one processor is further programmed to:

monitor at least one diving status parameter of a user;

calculate the at least one diving status parameter of the user;

store the at least one diving status parameter in memory; and display the at least one diving status parameter onto the display member.

3. The device of claim 2 wherein the at least one processor is further programmed to receive input in relation to the at least one diving status parameter from the control panel.

4. The device of claim 1 wherein the digital camera subsystem further comprises:

a means for capturing still images; and a means for capturing motion video images.

5. The device of claim 4 wherein the digital camera subsystem further comprises:

a means for viewing still images; and a means for viewing motion video images.

6. The device of claim 1 wherein the satellite receiver subsystem further comprises:

a satellite receiver for receiving signals from an earth orbiting satellite; and the at least one microprocessor is programmed to:

calculate the position of the user based upon the received satellite signals.

7. The device of claim 6 wherein the satellite receiver subsystem further comprises:

at least one navigation map stored in memory; and the at least one microprocessor is programmed to:

calculate at least one navigation status parameter based upon the at least one navigation map; and display the at least one navigation parameters onto the display member.

8. The device of claim 5 wherein the at least one microprocessor is further programmed to receive input in relation to the at least one navigation parameters from the user.

9. The device of claim 1 further comprising a communication port operably connected to the at least one microprocessor and the memory.

10. The device of claim 7 wherein the at least one microprocessor is programmed to:

transfer information from the memory into a host computing device connected to the communication port; and transfer information from the connected host computing device and into the memory.

11. The device of claim 1 further comprising a power source operably connected to the at least one microprocessor and the display.

12. The device of claim 1 wherein the control panel further comprises:

a waterproof protective covering;

a flat panel display below the covering; and a light source operably connected to the flat panel display below the covering.

13. The device of claim 12 wherein the fiat panel assembly is a Liquid Crystal Display (LCD).

14. The device of claim 12 wherein the flat panel display is operably connected to a color graphics card.

15. The device of claim 11 wherein the power source is a rechargeable battery unit.

16. The device of claim 15 wherein the power source further comprises:

a portable battery unit enclosed in a waterproof covering; and a waterproof electrical receiver operably connected to the battery unit;

and a waterproof electrical mate connector adapted to operably conned to the electrical receiver and to the microprocessor wherein the battery unit can be replaced under water.

17. The device of claim 1 further comprising a compass operable associated with the at least one microprocessor such that the current readings from the compass can be displayed on the display member.

18. The device of claim 1 further comprising a temperature sensor operable associated with the at least one microprocessor such that the current readings from the temperature sensor can be displayed on the display member.

19. The device of claim 1 further comprising:

an audible tone operable associated with the at least one microprocessor such that the at least one microprocessor is programmed to initiate a tone when the divers air tank is too low, the diver is ascending too rapidly or the diver is descending too rapidly.

* * * * *